US011527223B2

(12) United States Patent
Liu et al.

(10) Patent No.: US 11,527,223 B2
(45) Date of Patent: Dec. 13, 2022

(54) SYSTEM AND METHOD FOR GENERATING MUSICAL SCORE

(71) Applicant: SUNLAND INFORMATION TECHNOLOGY CO., LTD., Shanghai (CN)

(72) Inventors: Xiaolu Liu, Shanghai (CN); Bin Yan, Shanghai (CN); Zhe Zhu, Shanghai (CN); Liren Jin, Shanghai (CN); Xinle Hou, Shanghai (CN)

(73) Assignee: SUNLAND INFORMATION TECHNOLOGY CO., LTD., Shanghai (CN)

( * ) Notice: Subject to any disclaimer, the term of this patent is extended or adjusted under 35 U.S.C. 154(b) by 214 days.

(21) Appl. No.: 16/920,751

(22) Filed: Jul. 5, 2020

(65) Prior Publication Data

US 2020/0335072 A1 Oct. 22, 2020

Related U.S. Application Data

(63) Continuation of application No. PCT/CN2018/082787, filed on Apr. 12, 2018.

(51) Int. Cl.
*G10G 3/04* (2006.01)
*G10G 1/04* (2006.01)
(Continued)

(52) U.S. Cl.
CPC ..... *G10G 3/04* (2013.01); *G10G 1/04* (2013.01); *G10H 1/0008* (2013.01);
(Continued)

(58) Field of Classification Search
CPC ..... G10G 3/04; G10G 1/04; G10H 1/0008; G10H 1/348; G10H 2210/061;
(Continued)

(56) References Cited

U.S. PATENT DOCUMENTS 5,038,658 A * 8/1991 Tsuruta ..... G10G 3/04 84/475
5,908,996 A * 6/1999 Litterst ..... G10H 1/34 84/670
(Continued)

FOREIGN PATENT DOCUMENTS

CN 1378197 A 11/2002
CN 1379696 A 11/2002
(Continued)

OTHER PUBLICATIONS

First Office Action in Chinese Application No. 201810325653.5 dated Apr. 14, 2021, 21 pages.
(Continued)

*Primary Examiner* — Christina M Schreiber
(74) *Attorney, Agent, or Firm* — Metis IP LLC

(57) ABSTRACT

A method for generating a musical score based on user performance during playing a keyboard instrument may include detecting a status change of a plurality of execution devices of the keyboard instrument. The method may include generating a first signal according to the detected status change. The method may include generating a second signal indicating a plurality of timestamps. The method may include determining a tune of the musical score based on the first signal. The method may include determining a rhythm of the musical score based on the second signal. The method may further include generating the musical score based on the tune and the rhythm of the musical score.

20 Claims, 8 Drawing Sheets

(51) Int. Cl.
*G10H 1/00* (2006.01)
*G10H 1/34* (2006.01)

(52) U.S. Cl.
CPC ..... *G10H 1/348* (2013.01); *G10H 2210/061* (2013.01); *G10H 2210/071* (2013.01); *G10H 2210/076* (2013.01); *G10H 2210/086* (2013.01); *G10H 2220/121* (2013.01); *G10H 2220/305* (2013.01); *G10H 2220/455* (2013.01)

(58) Field of Classification Search
CPC ..... G10H 2210/071; G10H 2210/076; G10H 2210/086; G10H 2220/121; G10H 2220/305; G10H 2220/455
USPC ..... 84/609
See application file for complete search history.

(56) References Cited

U.S. PATENT DOCUMENTS

| | | | | |
|---|---|---|---|---|
| 11,288,975 | B2 * | 3/2022 | Jancsy | G09B 15/023 |
| 2012/0067196 | A1 * | 3/2012 | Rao | G10H 1/363 84/611 |
| 2013/0106689 | A1 * | 5/2013 | Salsman | G10H 1/0008 345/156 |
| 2013/0305908 | A1 * | 11/2013 | Iwase | G10H 1/06 84/624 |
| 2016/0118030 | A1 * | 4/2016 | Zhang | G10H 1/34 84/601 |
| 2018/0342230 | A1 * | 11/2018 | Teng | G10H 1/346 |
| 2018/0350336 | A1 * | 12/2018 | Zhao | G10G 3/04 |
| 2019/0051277 | A1 * | 2/2019 | Yan | G10H 1/00 |
| 2019/0272810 | A1 * | 9/2019 | Yan | G10H 1/0008 |
| 2020/0335072 | A1 * | 10/2020 | Liu | G10H 1/0008 |

FOREIGN PATENT DOCUMENTS

| | | | | | |
|---|---|---|---|---|---|
| CN | 102014195 | A | | 4/2011 | |
| CN | 201994051 | U | * | 9/2011 | |
| CN | 201994051 | U | | 9/2011 | |
| CN | 103377647 | A | | 10/2013 | |
| CN | 103824565 | A | | 5/2014 | |
| CN | 103854644 | A | | 6/2014 | |
| CN | 203746413 | U | | 7/2014 | |
| CN | 104485090 | A | | 4/2015 | |
| CN | 103824565 | B | | 2/2017 | |
| CN | 106409028 | A | | 2/2017 | |
| CN | 106652964 | A | | 5/2017 | |
| CN | 106782460 | A | | 5/2017 | |
| CN | 106935227 | A | | 7/2017 | |
| CN | 107067879 | A | | 8/2017 | |
| CN | 206497597 | U | | 9/2017 | |
| CN | 107274876 | A | | 10/2017 | |
| CN | 108281128 | A | | 7/2018 | |
| CN | 109155125 | A | * | 1/2019 | G01P 13/00 |
| CN | 110010106 | A | * | 7/2019 | |
| CN | 110379400 | A | * | 10/2019 | G10H 1/0008 |
| EP | 2760014 | B1 | | 6/2016 | |
| JP | 2006069288 | A | * | 3/2006 | |
| JP | 2010518428 | A | * | 5/2010 | |
| JP | 4666591 | B2 | | 4/2011 | |
| KR | 100664677 | B1 | | 1/2007 | |
| KR | 102258729 | B1 | * | 5/2021 | |
| WO | WO-2010115519 | A1 | * | 10/2010 | G10H 1/0008 |
| WO | WO-2014137311 | A1 | * | 9/2014 | A63F 13/00 |
| WO | 2018090798 | A1 | | 5/2018 | |
| WO | WO-2019057343 | A1 | * | 3/2019 | G10H 1/0008 |

OTHER PUBLICATIONS

International Search Report in PCT/CN2018/082787 dated Jan. 18, 2019, 5 pages.
Written Opinion in PCT/CN2018/082787 dated Jan. 18, 2019, 5 pages.
Cao, Xizheng et al., Automated Composition Algorithm for Gentle Music Based on Pitch Melody Unit, Acta Automatica Sinica, 38(10): 1627-1638, 2012.
Li, Yenfang et al., Development on an Intelligent Music Score Input System—Applied for the Piano Robot, 2016 Asia-Pacific Conference on Intelligent Robot Systems, 2016, 5 pages.

* cited by examiner

SYSTEM AND METHOD FOR GENERATING MUSICAL SCORE

CROSS-REFERENCE TO RELATED APPLICATIONS

This application is a Continuation of International Application No. PCT/CN2018/082787, filed on Apr. 12, 2018, the entire contents of which are hereby incorporated by reference.

TECHNICAL FIELD

This application relates to the field of performance detection, and more particularly, recording the user performance for composing musical score.

BACKGROUND

A keyboard instrument is a musical instrument with a keyboard. Exemplary keyboard instruments may include pianos, organs, accordions, or the like. The keyboard instrument has been widely used for entertainment, learning, and other purposes. Some of the keyboard instrument can record a user's performance when the user operates the keyboard instrument. That type of keyboard instrument makes it possible for a composer to compose a musical score using the keyboard instrument directly instead of writing the musical score on papers in the form of audio files. It may be desirable to provide a method and system to generate musical scores while the user operates the instrument.

SUMMARY

According to an aspect of the present disclosure, a method for generating a musical score based on user performance during playing a keyboard instrument may be provided. The method may include detecting a status change of a plurality of execution devices of the keyboard instrument by a first sensor; generating a first signal according to the detected status change by the first sensor; generating a second signal indicating a plurality of timestamps by a second sensor; determining a tune of the musical score based on the first signal by a processor; determining a rhythm of the musical score based on the second signal by the processor; generating the musical score based on the tune and the rhythm of the musical score by the processor.

In some embodiments, the method may further include displaying the musical score on a user interface.

In some embodiments, the method may further include receiving an input related to one or more composing parameters associated with the musical score by a user interface.

In some embodiments, the one or more composing parameters related to the musical score may include one of a time signature, a key signature, a clef, or a number count of measures.

In some embodiments, the generating the musical score based on the tune and the rhythm of the musical score may include generating a plurality of notes based on the tune; generating a plurality of measures based on the rhythm; classifying the plurality of notes into the plurality of measures; generating the musical score based on the classified notes and the input related to one or more composing parameters associated with the musical score.

In some embodiments, one of the plurality of the measures may be determined based on two of the plurality of timestamps.

In some embodiments, the execution devices may include at least one of a key, a pedal, a hammer, a weight lever, or a string.

In some embodiments, the status change of the execution devices may include at least one of a position change of a key, a position change of a pedal, a position change of a hammer, or a vibration status change of a string.

In some embodiments, the method may further include receiving one or more instructions for modifying the musical score by a user interface; modifying the musical score based on the one or more instructions by the processor.

According to another aspect of the present disclosure, a system for generating a musical score based on user performance during playing a keyboard instrument is provided. The system may include at least one storage device, a first sensor, a second sensor, at least one processor in communication with the at least one storage device. The at least one storage device may include store a set of instructions. The first sensor may be configured to detect a status change of a plurality of execution devices of the keyboard instrument, and generate a first signal according to the detected status change. The second sensor may be configured to generate a second signal indicating a plurality of timestamps. When executing the instructions, the at least one processor is configured to cause the system to obtain the first signal, obtain the second signal, determine a tune of the musical score based on the first signal, determine a rhythm of the musical score based on the second signal and generate the musical score based on the tune and the rhythm of the musical score.

In some embodiments, the system may include a user interface configured to display the musical score.

In some embodiments, the user interface may be further configured to receive an input related to one or more composing parameters associated with the musical score.

In some embodiments, the one or more composing parameters related to the musical score may include one of a time signature, a key signature, a clef, or a number count of measures.

In some embodiments, when the at least one processor generates the musical score based on the tune and the rhythm of the musical score, the at least one processor may be further configured to cause the system to generate a plurality of notes based on the tune, generate a plurality of measures based on the rhythm, classify the plurality of notes into the plurality of measures and generate the musical score based on the classified notes and the input related to one or more composing parameters associated with the musical score.

In some embodiments, one of the plurality of measures may be determined based on two of the plurality of timestamps.

In some embodiments, the execution devices may include at least one of: a key, a pedal, a hammer, a weight lever, or a string.

In some embodiments, the status change of the execution devices may include at least one of a position change of a key, a position change of a pedal, a position change of a hammer, or a vibration status change of a string.

In some embodiments, the at least one processor is further configured to cause the system to receive one or more instructions for modifying the musical score, and modify the musical score based on the one or more instructions.

According to another aspect of the present disclosure, a non-transitory computer readable medium embodying a computer program product is provided. The computer program product may comprise instructions that cause a computing device to effectuate a method. The method may include one or more of the following operations. The computing device may detect a status change of a plurality of execution devices of the keyboard instrument by a first sensor, and generate a first signal according to the detected status change by the first sensor. The computing device may generate a second signal indicating a plurality of timestamps by a second sensor. The computing device may determine a tune of the musical score based on the first signal by a processor. The computing device may determine a rhythm of the musical score based on the second signal by the processor. The computing device may generate the musical score based on the tune and the rhythm of the musical score by the processor.

According to another aspect of the present disclosure, a system for generating a musical score based on user performance during playing a keyboard instrument is provided. The system may include a signal acquisition module and a signal processing module. The signal acquisition module may detect a status change of a plurality of execution modules of the keyboard instrument, generate a first signal according to the detected status change and generate a second signal indicating a plurality of timestamps. The signal processing module may determine a tune of the musical score based on the first signal, determine a rhythm of the musical score based on the second signal, and generate the musical score based on the tune and the rhythm of the musical score.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

Figure 1:
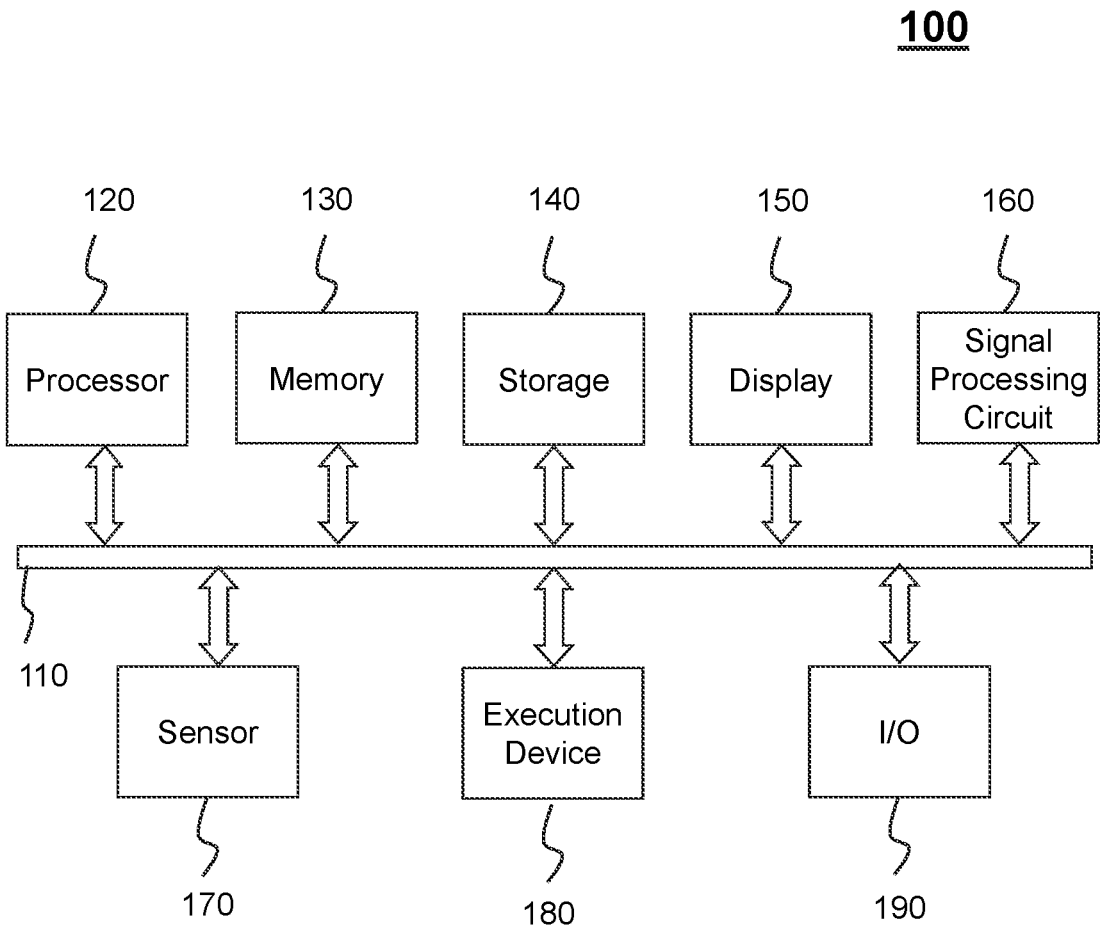
FIG. 1 is a block diagram illustrating an exemplary keyboard instrument system according to some embodiments of the present disclosure.

In the following detailed description, numerous specific details are set forth by way of examples in order to provide a thorough understanding of the relevant disclosure. However, it should be apparent to those skilled in the art that the present disclosure may be practiced without such details. In other instances, well-known methods, procedures, systems, components, and/or circuitry have been described at a relatively high-level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but to be accorded the widest scope consistent with the claims.

It will be understood that the term "system," "unit," "module," and/or "engine" used herein are one method to distinguish different components, elements, parts, section or assembly of different level in ascending order. However, the terms may be displaced by another expression if they may achieve the same purpose.

It will be understood that when a unit, module or engine is referred to as being "on," "connected to," or "coupled to" another unit, module, or engine, it may be directly on, connected or coupled to, or communicate with the other unit, module, or engine, or an intervening unit, module, or engine may be present, unless the context clearly indicates otherwise. As used herein, the term "and/or" includes any and all combinations of one or more of the associated listed items.

The terminology used herein is to describe particular examples and embodiments only and is not intended to be limiting. As used herein, the singular forms "a," "an," and "the" may be intended to include the plural forms as well, unless the context clearly indicates otherwise. It will be further understood that the terms "include," and/or "comprise," when used in this disclosure, specify the presence of integers, devices, behaviors, stated features, steps, elements, operations, and/or components, but do not exclude the presence or addition of one or more other integers, devices, behaviors, features, steps, elements, operations, components, and/or groups thereof.

An aspect of this present disclosure relates to a system and a method for recording the user performance for composing musical score. The system may determine a musical tune based on a first signal, which may indicate a status change of a plurality of execution devices of the keyboard instrument. The first signal may be obtained or detected by one or more sensors. The plurality of the execution devices may include a key, a pedal, a weight lever and/or a string. The system may further generate a plurality of musical notes corresponding to the musical tune. The system may determine a musical rhythm based on a second signal, which indicates a plurality of timestamps recording the specific performance by the user. For example, the specific performance may include a nodding, a shaking, and/or a specific sound produced by the user, or the like, or a combination thereof. The system may further generate a plurality of measures corresponding to the musical rhythm. The system may further generate a musical score based on the classified notes and the composing parameters.

FIG. 1 is a block diagram illustrating an exemplary keyboard instrument system 100 according to some embodiments of the present disclosure. As shown in FIG. 1, the keyboard instrument system 100 may include, a data bus 110, a processor 120, a memory 130, a storage 140, a display 150, a signal processing circuit 160, one or more sensors 170, one or more execution device 180, and one or more I/O devices 190. More or fewer components may be included in the keyboard instrument system 100 without loss of generality and its functionality. For example, two of the above-mentioned components may be combined into a single device, or one of the components may be divided into two or more devices. The components may be in communication with each other via the data bus 110. The data bus 110 may be used to facilitate data communications between the components of the keyboard instrument system 100.

In some embodiments, the processor 120 may be configured to process data and/or signals. The processor 120 may be configured to execute instructions stored in memory 130 and/or storage 140. When executing the instructions, the processor 120 may cause the keyboard instrument system 100 to perform one or more functions disclosed in the present disclosure. For example, the processor 120 may process the first signal indicating a status change of an execution device 180 (e.g., a key, a pedal) of the keyboard instrument. The processor 120 may also be configured to determine the tune and rhythm according to the user's performance and generate a musical score. Exemplary processor 120 may include a microcontroller, a reduced instruction set computer (RISC), an application specific integrated circuits (ASICs), an application-specific instruction-set processor (ASIP), a central processing unit (CPU), a graphics processing unit (GPU), a physics processing unit (PPU), a microcontroller unit, a digital signal processor (DSP), a field programmable gate array (FPGA), an acorn reduced instruction set computing (RISC) machine (ARM), and any other circuit and/or processor capable of executing the functions described herein, or the like, or any combination thereof.

The memory 130 may be configured to store data. Exemplary types of data may include MIDI files, user information, musical tune, musical rhythm, or the like, or a combination thereof. The memory 130 may also be configured to store the instructions executed by the processor 120. The memory 130 may include a random-access memory (RAM), a dynamic random-access memory (DRAM), a static random-access memory (SRAM), a thyristor random-access memory (T-RAM), a zero-capacitor random-access memory (Z-RAM), a read-only memory (ROM), a mask read-only memory (MROM), a programmable read-only memory (PROM), a field programmable read-only memory (FPROM), one-time programmable non-volatile memory (OTP NVM), and any other circuit and/or memory capable of executing the functions described herein, or the like, or any combination thereof.

The storage 140 may be configured to store data. Exemplary types of data may include MIDI files, user information, musical tune, musical rhythm, or the like, or a combination thereof. The storage 140 may also be configured to store the instructions executed by the processor 120. The storage 140 may include a direct attach storage (DAS), a fabric-attached storage (FAS), a storage area network (SAN), a network attached storage (NAS), any other circuit and/or storage capable of executing the functions described herein, or the like, or any combination thereof. In some embodiments, the keyboard instrument system 100 may include either one or both of the memory 130 and the storage 140.

The display 150 may be configured to display a user interface. For example, the display 150 may be configured to display a musical score generated. Exemplary display 150 may include a electroluminescent display (ELD), a light emitting diode display (LED), a cathode ray tube (CRT), a liquid-crystal display (LCD), a plasma display panel (PDP), an organic light-emitting diode (OLED), an organic light-emitting transistor (OLET), a surface-conduction electron-emitter display (SED), a field emission display (FED), a quantum dot display (QD-LED), a ferroelectric liquid crystal display (FLCD), a telescopic pixel display (TPO), a laser-powered phosphor display (LPD), any other circuit and/or display capable of executing the functions described herein, or the like, or any combination thereof. In some embodiments, the exemplary display 150 may be a touchscreen. For example, the touchscreen may include a capacitive touchscreen, a resistive touchscreen, a surface acoustic wave touchscreen, an infrared touchscreen, or an optical touchscreen, or a combination thereof. Generally, the processor 120, the memory 130, the storage 140, the display 150, and other components may be integrated into one device, e.g., a desktop, a laptop, a mobile phone, a tablet computer, a wearable computing device, or the like, or a combination thereof.

The signal processing circuit 160 may be configured to process signals detected by the sensor(s) 170 and/or any other components of the keyboard instrument system 100. The signals may include a first signal(s) indicating the status change of the execution devices, a second signal indicating a timestamp associated with a musical rhythm. Exemplary signal processing circuit 160 may include a signal amplification circuit, a signal conversion circuit, a signal filtering circuit, a channel selecting circuit, an analog-to-digital converter, or any other circuit capable of executing the functions described herein, or the like, or any combination thereof.

The sensor(s) 170 may be configured to detect operations on the keyboard instrument system 100 by a user when the user plays the keyboard instrument system 100. Various types of sensors may be mounted inside or outside of the keyboard instrument system 100. For example, a camera (i.e., a type of sensor 170) may be used to record user performance. A microphone (i.e., another type of sensor 170) may be used to detect sound generated by the keyboard instrument system 100 and/or the humming caused by the user. A motion detection sensor may be used to detect motions of the components of the keyboard instrument system 100 (e.g., a key, a pedal, a string). The sensor(s) 170 may include, for example, one or more electro-optical sensors, electromagnetic sensors, Hall sensors, vibration sensors, ultrasonic sensors, laser sensors, motion sensors, piezoelectricity sensors, pressure sensors, torque sensors, differential pressure sensors, resistance sensors, conductivity sensors, tilt sensors or any other circuit and/or sensor capable of executing the functions described herein, or the like, or any combination thereof. In some embodiments, the sensor(s) 170 may transmit the generated signals to the processor 120 for further processing. For example, the processor 120 may determine a musical tune based on a signal indicating a status change of a plurality of execution devices of the keyboard instrument. As another example, the processor 120 may determine a musical rhythm based on a signal that indicates a plurality of timestamps associated with a plurality of beats.

The execution device 180 may include one or more components of the keyboard instrument system 100 that may be activated during the operation. Exemplary execution device 180 may include one or more keys, pedals, hammers, weight levers, strings, or the like, or a combination thereof. In some embodiments, the keys may include a plurality of white keys and a plurality of black keys. A typical piano keyboard may include eighty-eight keys, including fifty-two longer white keys and thirty-six shorter black keys. The white keys may control the playing of the seven natural major notes of the western scale, organized from lowest to highest in pitch, including C, D, E, F, G, A, B, for the C major scale. The black keys may control the playing of the five sharp and/or minor notes that are associated with the major scale. The corresponding notes may be played by pressing the keys. In some embodiments, the pedals of the typical piano keyboard instrument may include three pedals: the soft pedal, sostenuto, and sustain pedal. One or more extended pedals, except those three pedals, may be placed in the keyboard instrument. The extended pedal(s) may perform one or more functions. For example, a timestamp associated with the musical rhythm may be determined according to a moment when the user pushes the extended pedal. In some embodiments, for the keyboard instrument, the pressing of the various keys may cause the corresponding hammers and/or weight levers to strike their respective strings, thereby causing the strings to vibrate at their resonant frequencies to generate sounds.

The I/O device(s) 190 may be configured to allow a user to interact with the keyboard instrument system 100. The I/O device(s) 190 may include one or more common input and output devices, e.g., a keyboard, a mouse, an audio output device (e.g., a microphone), a printer, a display, etc. In some embodiments, the I/O device(s) 190 may be configured to allow the user to interact with the keyboard instrument system 100 via a touch screen and/or a touchable surface. In some embodiments, the I/O device(s) 190 may be configured to allow the user to interact with the keyboard instrument system 100 via voice recognition and/or vision recognition.

Figure 2:
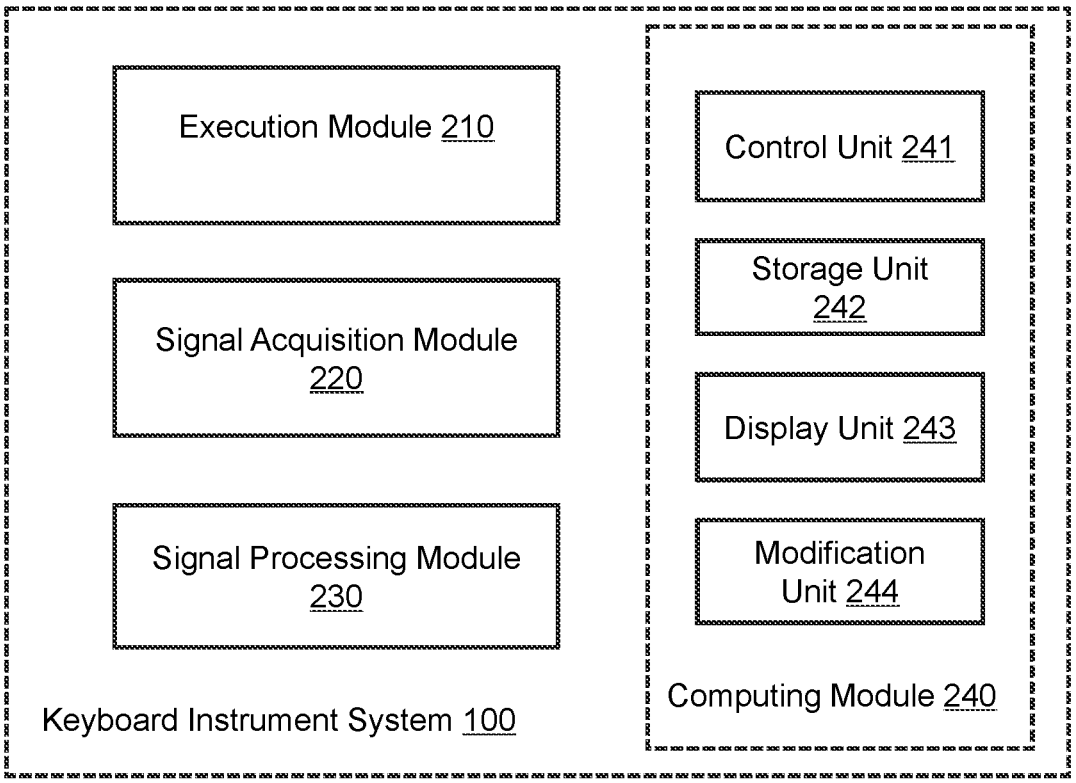
FIG. 2 is a block diagram illustrating an exemplary keyboard instrument system according to some embodiments of the present disclosure.

FIG. 2 is a block diagram illustrating an exemplary keyboard instrument system according to some embodiments of the present disclosure. As shown in FIG. 2, the keyboard instrument system 100 may include an execution module 210, a signal acquisition module 220, a signal processing module 230, and a computing module 240. The computing module 240 may further include a control unit 241, a storage unit 242, a display unit 243, and a modification unit 244. The connection between the modules may be wired or wireless. Data and/or signals may be transmitted between the modules.

Generally, the terms "module," "unit," and/or "engine" used herein, refers to logic embodied in hardware or firmware, or to a collection of software instructions. At least one processor may execute the instructions. The modules, units, and engines described herein may be implemented as software and/or hardware modules and may be stored in any type of non-transitory computer-readable medium. In some embodiments, a software module may be compiled and linked into an executable program. It will be appreciated that software modules can be callable from other modules or from themselves, and/or can be invoked in response to detected events or interrupts. Software modules configured for execution on computing devices (e.g., processor 120) can be provided on a computer-readable medium, such as a compact disc, a digital video disc, a flash drive, a magnetic disc, or any other tangible medium, or as a digital download (and can be originally stored in a compressed or installable format that requires installation, decompression, or decryption prior to execution). Such software code can be stored, partially or fully, on a memory device of the executing computing device, for execution by the computing device. Software instructions can be embedded in firmware, such as an EPROM. It will be further appreciated that hardware modules can be included of connected logic units, such as gates and flip-flops, and/or can be included of programmable units, such as programmable gate arrays or processors. The modules or computing device functionality described herein are preferably implemented as software modules, but can be represented in hardware or firmware. In general, the modules described herein refer to logical modules that can be combined with other modules or divided into sub-modules despite their physical organization or storage.

The execution module 210 may include the execution device(s) 180 as described in connection with FIG. 1. The execution module 210 may include one or more keys, pedals, hammers, weight levers, strings, and/or any other components of the keyboard instrument that may be activated during the operation by a user. In some embodiments, the execution module 210 may generate an event in response to the user operation. For example, the event may be determined and generated according to a status change of the execution device caused by the user operation. The type of the event may include but is not limited to, a motion, sound, vibration, or the like, or a combination thereof. The type of the event caused by the execution module 210 may depend on the execution device(s) 180 included therein. For example, if a user presses a key, a key motion may be generated as an event in response to the user operation. Likewise, the pedal motion trod by the user may be an event. Accordingly, motions of some components of the keyboard instrument system 100 in response to the motion of the key and/or the pedal may be an event. Merely by way of example, a hammer may strike a string of the keyboard instrument system 100 in response to a key pressing by the user. The motion of the hammer and/or the vibration of the string may be an event. As a result, the vibration of the string, a sound may be generated. The generated sound may also be an event. Likewise, any status change of the execution devices included therein may be generated as an event. An event may include operation information of the user. For example, when a user presses a key of the keyboard instrument system 100, the operation information relating to the key pressing event may be detected by the sensor(s), including the type of the pressing key, the pressing strength, time of the pressing, the pressing duration, or the like, or any combination thereof. As another example, when a user steps on a pedal, the operation information relating to the pedal stepping event may be detected by the sensor(s) 170, including the type of the stepping pedal, the stepping strength, the time of the stepping, the stepping duration, or the like, or any combination thereof. In some embodiments, the operation information may be acquired by the signal acquisition module 220 and transmitted to the signal processing module 210 and/or the computing module 240 for further processing.

The signal acquisition module 220 may be configured to obtain a plurality of signals. In some embodiments, the plurality of signals may include the first signals and/or the second signals. The first signal may indicate the status change of the plurality of execution devices 180 disclosed in FIG. 1. The second signal may indicate a plurality of timestamps in response to a musical rhythm. The signal acquisition module 220 may include the first sensor(s) and the second sensor(s). The first sensor(s) may be configured to detect an event generated by the execution module 210 to generate the first signal(s). The second sensor(s) may be configured to generate the second signal(s). In some embodiments, the first sensor(s) and the second sensor(s) may be same or similar to the sensor(s) 170 illustrated in FIG. 1.

The configuration of the first sensors (e.g., the numbers and/or positions of the sensors) may depend on the type of the event to be detected. For example, a plurality of electro-optical sensors may be positioned under the plurality of keys of the keyboard instrument system 100 to detect the motion event of individual keys. In some embodiments, the event to be detected may be a mechanical motion of a component of the keyboard instrument system 100, such as the keys, the pedals. The position of the sensor(s) 170 may depend on where the event occurs. For example, the sensor(s) 170 may be positioned on or near a string to detect a vibration of the string. The sensor(s) 170 may be positioned on or near the plurality of keys to detect the key motion. The sensor(s) 170 may be positioned on or near a linkage structure (e.g., the hammer, the weight lever) of the keyboard instrument system 100 to detect the strike by the linkage structure. In some embodiments, the numbers of the sensor(s) 170 may depend on the numbers of the keys of the keyboard instrument system 100. For example, a sensor 170 may correspond to a certain number of keys (e.g., two or four keys) of the keyboard instrument system 100. The sensor(s) 170 included in the signal acquisition module 220 may be positioned inside or external to the keyboard or piano (i.e., a component of the keyboard instrument system 100), and the position of the sensor(s) 170 may depend on the event to be detected or the method to detect a certain event. For example, if a camera (i.e., a sensor 170), configured to detect the operation by the user on the keys of the keyboard or piano (also referred herein to as an event), may be attached to or placed away from the keyboard or piano. The signal acquisition module 220 may generate a signal in response to a detected event, such as the mechanical motion of one of the execution devices 180. The signal may be a voltage signal, a current signal, or the like, or a combination thereof.

Similar to the configuration of the first sensor(s), the type of the second sensor(s) may depend on the method to detect the timestamps associated with the musical rhythm according to a user's performance. For example, a nodding or shaking his/her head may represent a hinting signal that indicates the musical rhythm (e.g., a beat), and a camera (i.e., a second sensor) may be configured to acquire the corresponding image of the nodding or the shaking in order to record the timestamp of occurring the nodding and/or shaking. As another example, a specific sound produced by the user (e.g., a humming) may represent the hinting signal that indicates the musical rhythm, an audio sensor (i.e., so-called the second sensor) may be configured to detect the specific sound in order to record the timestamp when the specific sound is detected. As still another example, a motion sensor, which may be placed on the extend pedal, may be configured to detect the hinting signal based on the position change (e.g., the movement) of the extend pedal. The extend pedal may be a pedal different from the typical three pedals of the keyboard instrument, such as the soft pedal, sostenuto, and sustain pedal. A corresponding timestamp may be recorded once the user steps on and pushes the extend pedal. For those skilled in the art, various types of sensors may be used to detect the hinting signal that indicates the musical rhythm.

The signal processing module 230 may be configured to process the generated signal and further transmit the processed signal to the computing module 240. The signal processing module 230 may include the signal processing circuit 160 disclosed in FIG. 1. In some embodiments, the detected signal may be preprocessed by the signal processing module 230. Exemplary preprocessing may include amplifying, frequency-selecting, smoothing, peak holding, channel selecting, analog-to-digital converting, or the like, or a combination thereof. In some embodiments, the signal processing module 230 may determine a musical tune based on the first signal indicating the status change of the plurality of execution devices while the user plays the keyboard instrument. In some embodiments, the signal processing module 230 may determine a musical rhythm based on the second signal indicating the plurality of timestamps. The timestamp may refer to the moment when the user inputs the musical rhythm (e.g., a beat) by the performance while playing the keyboard instrument. In some embodiments, the signal processing module 230 may further generate a musical score based on the musical tune and the musical rhythm. In some embodiments, the signal processing module 230 may transmit the musical score, in the form of electromagnetic signals or radio-frequency signals, to the computing module 240 via a wired connection and/or wireless connection.

The computing module 240 may be configured to receive and process the processed signal transmitted from the signal processing module 230. The computing module 240 may include a control unit 241, a storage unit 242, a display unit 243, and a modification unit 244. The computing module 240 may include the processor 120 described elsewhere in this disclosure (e.g., FIG. 1 and the descriptions thereof). The computing module 240 may be integrated into or external to the keyboard instrument system 100. In some embodiments, the units in the computing module 240 may be set inside the keyboard instrument system 100. For example, in a piano, a computer may be configured inside the piano. In some embodiments, a traditional keyboard instrument may be reconstructed to perform the functions of the keyboard instrument disclosed in the present disclosure. A removable computing module 240 may be available for the reconstructed traditional keyboard instrument. The connection between the reconstructed traditional keyboard instrument and the removable computing module 240 may through wired connection or wireless connection. The computing module 240 may be a computing device capable of performing the functions thereof disclosed in this application. Exemplary computing device may include PC (personal computer), mobile phone, tablet PC, laptop, or the like, or a combination thereof.

The control unit 241 in the computing module 210 may be configured to control operations one or more components of the keyboard instrument system 100. For example, the control unit 241 may control a sound box of the keyboard instrument to generate sounds. As another example, the control unit 241 may control an auto-play actuator (not shown) to playback a music melody based on the musical score generated by the signal processing module 230. In some embodiments, the control unit 241 may decode the electromagnetic signals of the musical score, and transmit the signals to the display unit 243 to display the musical score.

The storage unit 242 may include the memory 130 and the storage 140 as described in connection with in FIG. 1. The storage unit 242 may store some user information, a Musical Instrument Digital Interface (MIDI) file, an audio data and/or video data relating to the musical score, or the like, or a combination thereof.

The display unit 243 may include the display 150 described elsewhere in this disclosure (e.g., FIG. 1 and the descriptions thereof). The display unit 243 may be configured to display a user interface to the user. The display unit 243 may also display the musical score. The user may modify the musical score via the user interface (via, for example, the I/O 190). In some embodiments, the user may input one or more composing parameters associated with the musical score via the user interface. Exemplary composing parameters may include a time signature, a key signature, a clef, a number count of measures, or the like, or any combination thereof.

The modification unit 244 may be configured to perform some modification operations. In some embodiments, the modification unit 244 may modify a timing parameter relating to the musical tune and/or the musical rhythm. For example, when the user presses the keys of the keyboard instrument, a musical tune (in the form of a sound) may be generated in response to the pressing. However, the generated musical tune may be later than the time of pressing the corresponding keys due to mechanical delay or error of the keys of the keyboard instrument. For different keys, the mechanical delay or error may be different. The modification unit 244 may process the signals relating to the musical tune to compensate the timing delay or error. In some embodiments, the modification unit 244 may modify the generated musical score based on one or more instructions entered by the user. For example, upon the receipt of the instructions for adjusting musical notes order, the modification unit 244 may adjust the corresponding notes order according to the received instructions.

It should be noted that the keyboard instrument system 100 described above is provided for the purposes of illustration, and not intended to limit the scope of the present disclosure. Apparently for those skilled in the art, numerous variations and modifications may be conducted under the teaching of the present disclosure. However, those variations and modifications may not depart the protected scope of the present disclosure. For example, the signal processing module 230 may be integrated into the computing module 240.

Figure 3:
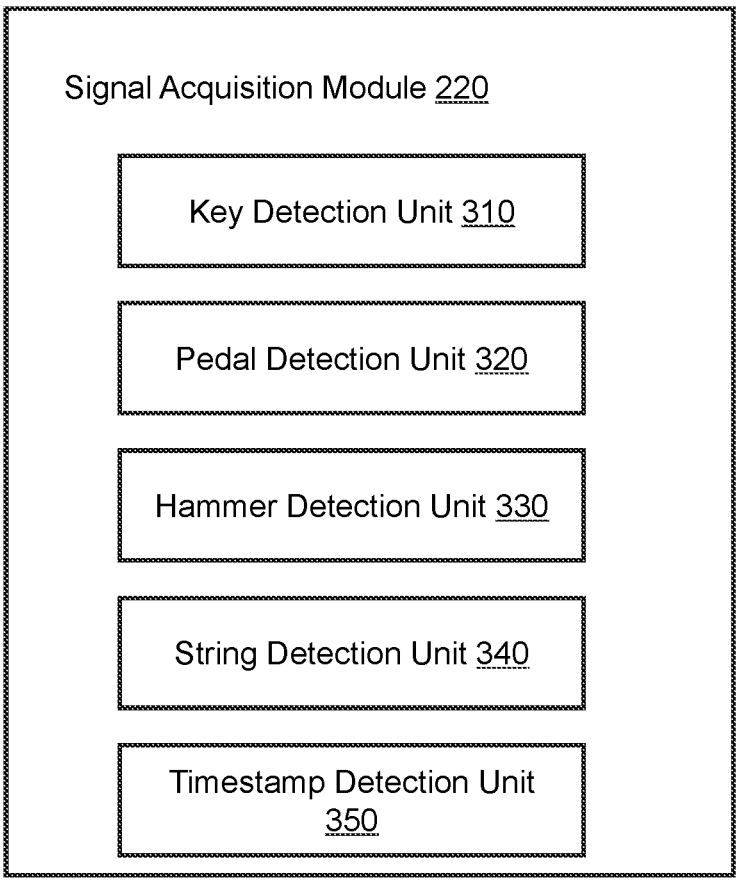
FIG. 3 is a block diagram illustrating an exemplary signal acquisition module according to some embodiments of the present disclosure.

FIG. 3 is a block diagram illustrating an exemplary signal acquisition module 220 according to some embodiments of the present disclosure. The signal acquisition module 220 may be configured to generate a plurality of first signals indicating the status change of the plurality of the execution devices 180, and generate a plurality of second signals indicating one or more timestamps associated with the musical rhythm (e.g., a beat). The signal acquisition module 220 may include a key detection unit 310, a pedal detection unit 320, a hammer detection unit 330, a string detection 340, and a timestamp detection unit 350. In some embodiments, various detection units may detect different signals.

The key detection unit 310 may be configured to detect one or more events caused by the keyboard of the keyboard instrument system 100. The events caused by the keyboard may be motion events of the keys. The key detection unit 310 may include one or more sensors (e.g., the sensor(s) 170). The sensor(s) 170 (e.g., a motion sensor) may be configured to detect the motion events. Exemplary motion sensor may include a pressure sensor chip, Hall element, electro-optical sensor, or the like, or a combination thereof. The position of the sensor(s) 170 may be determined according to the types of sensors. For instance, an electro-optical sensor (a type of motion sensors) may be mounted under or near the keys of the keyboard to detect the key motion of the keys. The sensor 170 may be positioned corresponding to each of the plurality of keys of the keyboard instrument system 100. In some embodiments, the sensor 170 may detect events caused by the motions of two or more keys and may not be able to distinguish the difference between the two or more keys. For example, two adjacent keys may correspond to one motion detection sensor. The events caused by the two adjacent keys may correspond to the same sound. For those skilled in the art, a key of the keyboard instrument system 100 may correspond to a musical note of a musical piece. Therefore, one or more corresponding musical notes may be generated according to the signals associated with the motion events of the keys detected by the key detection unit 310.

The pedal detection unit 320 may be configured to detect one or more events caused by the pedals. In some embodiments, the one or more events may include a movement of the pedals. The pedal detection unit 320 may include one or more sensors (e.g., the sensor 170). The traditional keyboard instrument 100 may include three pedals, such as the soft pedal, the sostenuto pedal, and the sustaining pedal. Each of the pedals may include one or more sensors 170 configured to detect the events caused by the user's operation on the pedal. The sensors 170 may generate one or more signals in response to the detected events. When the pedal is actuated, its movement (and the parameters related to the movement such as the speed, the distance the pedal travels, and the force applied on the pedal) may be detected by the pedal detection unit 320. For example, when the user pushes the sostenuto pedal, a signal in response to the pushing may be generated by the sensor 170 included in the pedal detection unit 320. One or more corresponding musical notes, indicating the staccato effect generated by the sostenuto, may be determined according to the signals generated by the sensor 170 included in the pedal detection unit 320.

The hammer detection unit 330 may be configured to detect one or more events caused by the hammers. The mechanical movement of keys and/or pedals may cause the movement of the corresponding hammers. The hammer detection unit 330 may detect various events caused by the hammers. Exemplary events caused by a hammer may include the velocity of the hammer movement, striking strength of the hammer, time duration of the movement, movement frequency, of the like, or a combination thereof. The hammer detection unit 330 may include one or more sensors (e.g., the sensor(s) 170), which may be positioned on or external to the hammers and/or the strings. For example, an electro-optical sensor (a type of motion detection sensors) may reside between a hammer and a corresponding string. In response to the hammer striking the string, the electro-optical sensor may detect the striking event caused by the hammer and generate a signal accordingly. As another example, a strength detection sensor may be positioned on or external to the hammer and/or on the string. In response to a hammer striking a string, the strength detection sensor may detect the strength of the striking and generate a signal accordingly. One or more corresponding musical symbols, indicating accents of one or more musical notes, may be generated according to the signal relating to the strength of the striking.

The string detection unit 340 may be configured to detect one or more events caused by the string(s). For those skilled in the art, every note sounded on the keyboard instrument system 100 may be the result of a string, or set of two or three strings, vibrating at a specific frequency. A vibration of a string may be generated in response to a hammer striking on the string. The motion of the keys and/or the pedals may conduct the hammer to strike the string. The events caused by the vibration of the string may be detected by the string detection unit 340. For example, a sensor (e.g., a tension sensor) included in the string detection unit 340 may detect the tension of the string when the string(s) is vibrating. In some embodiments, the string detection unit 340 may include one or more sensors (e.g., the sensor(s) 170). The sensor(s) 170 included in the string detection unit 340 may be positioned on and/or near the string. In some embodiments, the sensor(s) 170 positioned on the string may not affect the quality of the sound generated by the string. However, if the sensor(s) 170 is positioned on the string, the vibration parameters of the string may be changed, which causes the sound (i.e., the musical tune) generated by the string to change accordingly. In some embodiments, the sensor(s) 170 may be positioned near the string.

The timestamp detection unit 350 may be configured to determine a plurality of timestamps indicating a musical rhythm (e.g., a beat) of a music piece according to the user's performance. In other words, the timestamp detection unit 350 may determine the plurality of timestamps corresponding to the moment of the user's performance. The user's performance may include but not limited to a nodding, a shaking, a gesture, a specific pronunciation, etc. In some embodiments, the user may customize the performance to represent the musical rhythm (e.g., a beat). The timestamp detection unit 350 may include one or more sensors to detect the plurality of timestamps. These sensors mounted in the timestamp detection unit 350 may also be referred to as the second sensor(s) herein. For example, a nodding or shaking his/her head may represent a hinting signal that indicates the musical rhythm (e.g., a beat), and a camera (i.e., the second sensor) included in the timestamp detection unit 350 may acquire the corresponding image of the nodding or the shaking when the user composes a music piece by the keyboard instrument system 100. The timestamp detection unit 350 may determine the plurality of timestamps corresponding to the nodding or the shaking, based on the acquired images. As another example, a specific sound by the user may represent the hinting signal that indicates the musical rhythm, and an audio sensor included in the timestamp detection unit 350 may detect the specific sound. The timestamp detection 350 may determine the plurality of timestamps corresponding to the moment of the specific sound by the user.

It should be noted that the signal acquisition module 220 described above is provided for the purposes of illustration, and not intended to limit the scope of the present disclosure. Apparently for persons having ordinary skills in the art, numerous variations and modifications may be conducted under the teaching of the present disclosure. However, those variations and modifications may not depart the protecting scope of the present disclosure. Some units in the signal acquisition module 220 may be integrated into a single unit. For example, the hammer detection unit 330 and the string detection unit 340 may be integrated into a single unit.

Figure 4:
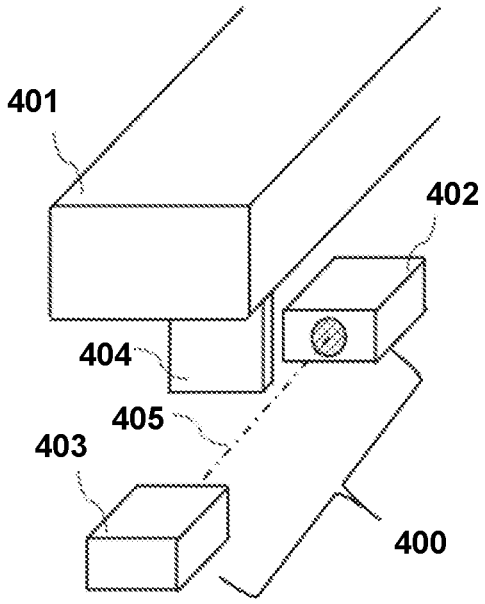
FIG. 4 is a schematic diagram illustrating an exemplary key motion detection structure according to some embodiments of the present disclosure.

FIG. 4 is a schematic diagram illustrating an exemplary key motion detection structure according to some embodiments of the present disclosure. Mechanisms for detecting motions of a key of a keyboard instrument using a sensor are illustrated. A sensor may be mounted under a key to detect the motion of the key. As shown in FIG. 4, the sensor 400 (e.g., an electro-optical sensor) may include a light-emitting element 402 and a light-detecting element 403. The light-emitting element 402 may include visible light-emitting (LED), laser LED, infrared LED, laser diode (LD), or photocell, or the like, or a combination thereof. The light-detecting element 403 may include phototube, active-pixel sensor (APS), bolometer, charge-coupled device (CCD), gaseous ionization detector, photoresistor, phototransistor, or the like, or a combination thereof. The light-emitting element 402 may generate light having various wavelengths. For example, the light-emitting element 402 may generate visible light, infrared light, ultraviolet (UV) light, etc. In some embodiments, the wavelength of the light emitted by the light-emitting element 402 may be controlled by one or more motors using a Pulse Width Modulation (PWM) mechanism. The light-detecting element 403 may be configured to receive the light and to convert it into an electronic signal (e.g., a current signal, a voltage signal).

In some embodiments, the light-emitting element 402 and the light-detecting element 403 may be positioned under the key 401. In some embodiments, a non-transparent extrusion (e.g., a plate 404) may be mounted to the surface of the key 401. The plate 404 may block the light emitted by the light-emitting element 402 reaching to the light-detecting element 403. The plate 404 may be mounted to the lower surface of the key 401 (e.g., the bottom of the key 401). The light-emitting element 402 may constantly emit light pointing to the light-detecting element 403. Alternatively, the light-emitting element 402 may also discontinuously emit light. For instance, there may be a certain waiting period between two light emissions. The waiting period may be adjusted by the control unit 241 according to the frequency of the user's pressing the keys.

In some embodiments, the light-emitting element 402 may emit a light beam 405. When the key 401 is not pressed down, the key 401 stays at a "top" position. When a user presses the key 401, the key may move downwards from the "top" position. When the key 401 does not go further, it reaches an "end" position. The plate 404 may move along with the key 401 and may block all or part of the light beam 405. The amount of the light detected by the light-detecting element 403 may vary due to the movement and position of the non-transparent plate 404. For example, when the key 401 moves toward the "end" position and blocks at least part of the light beam 405, the amount of light detected by the light-detecting element 403 may decrease. As another example, when the key 401 moves toward the "top" position, the amount of light detected by the light-detecting element 403 may increase. The light-detecting element 403 can determine information about the amount of the received light over time and can convert such information into one or more electronic signals (e.g., one or more key signals). The one or more electrical signals related to the keys may be transmitted to the signal processing module 220 for further processing.

Figure 5:
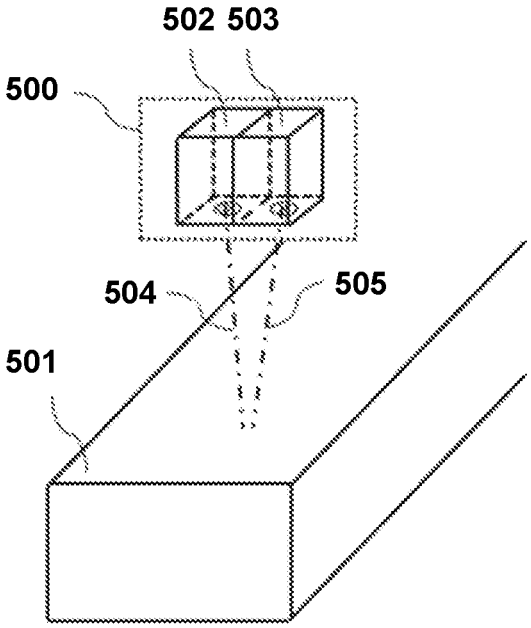
FIG. 5 is a schematic diagram illustrating an exemplary key motion detection structure according to some embodiments of the present disclosure.

FIG. 5 is a schematic diagram illustrating an exemplary key motion detection structure according to some embodiments of the present disclosure. The components in FIG. 5 may have the same structure as those in FIG. 4 except for the configurations. In some embodiments, the plate 404 may be omitted. The light-emitting element 502 and the light-detecting element 503 may be placed above or beneath the key 501, and the light beam 504 emitted by the light-emitting element 502 may not be able to travel directly pointing to the light-detecting element 503. The light beam 504 may point to and be reflected by the key 501. The reflected light 505 may then travel pointing to the light-detecting element 503 and may be received by the light-detecting element 503. When a user presses the key 501, the key may move downwards from the "top" position to the "end" position. The distance that the light beam 504 travels from the light-emitting element 502 to the light-detecting element 503 may depend on the movement of the key 501. For example, when the key 501 is pressed, the distance between the sensor 500 and the key 501 may change. The traveling distance of the beam 504 may change accordingly. The light-detecting element 503 may determine the time between light emission and light reception to record the change in distance that the light beam 504 travels. The change in distance may be converted into one or more electric signals by the light-detecting element 503. Thus, the motions of the key 501 may be recorded by the sensor 500.

The light-emitting elements and the light-detecting elements described above are not exhaustive and are not limiting. Numerous other changes, substitutions, variations, alterations, and modifications may be ascertained to one skilled in the art, and it is intended that the present disclosure encompass all such changes, substitutions, variations, alterations, and modifications as falling within the scope of the present disclosure.

Merely by way of example, as illustrated in FIG. 4 and/or FIG. 5, the described above may just illustrate the exemplary key motion detection structure. It is apparent for those skilled in the art that the similar configuration of the sensor 400 and/or the sensor 500 as shown in FIG. 4 and/or FIG. 5 may also be applied to detect the status change of other execution devices (e.g., the pedal, the hammer, the string) of the keyboard instrument system 100.

Figure 6:
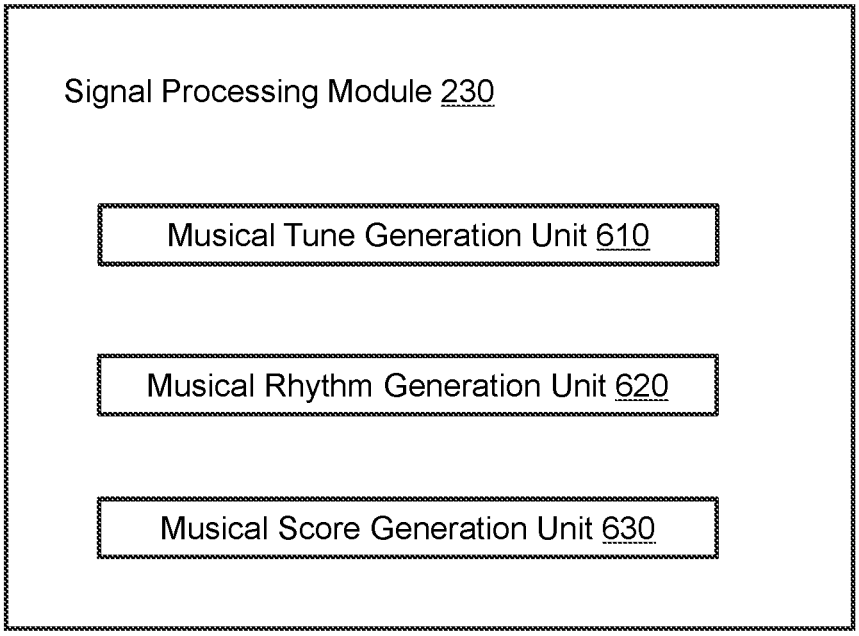
FIG. 6 is a block diagram illustrating an exemplary signal processing module according to some embodiments of the present disclosure.

FIG. 6 is a block diagram illustrating an exemplary signal processing module 230 according to some embodiments of the present disclosure. The signal processing module 230 may be configured to process the detected signals, such as the first signal(s) and the second signal(s), for generating a musical score that records a musical tune and a musical rhythm when the user is composing a musical piece. In some embodiments, the signal processing module 230 may be implemented by the signal processing circuit 160. The signal processing module 230 may include a musical tune generation unit 610, a musical rhythm generation unit 620 and a musical score generation unit 630.

The musical tune generation unit 610 may be configured to generate the musical tune. For example, the musical tune generation unit 610 may generate the musical tune based on the first signal(s) that indicates a status change of the plurality of the execution devices of the keyboard instrument system 100. The first signal(s) may include keystroke data, pedal pressing data, the hammer striking data, and/or string striking data. The one or more first sensors included in the signal acquisition module 220 may be configured to acquire the first signal(s) expressed in the form of electronic signals. In some embodiments, the musical tune generation unit 610 may produce pitches in accordance with the composed piece based on the first signal(s). In some embodiments, the musical tune generation unit 610 may convert the first signal(s) into tones. In some embodiments, the first signal(s) may be amplified and passed through a sound system (e.g., a loudspeaker) to form the musical sounds by the musical tune generation unit 610.

The musical rhythm generation unit 620 may be configured to generate a musical rhythm. For example, the musical rhythm generation unit 620 may generate the musical rhythm based on the second signal(s) that indicates a plurality of timestamps. In some embodiments, the timestamp may refer to the moment of the user's performance while playing the keyboard instrument. The second signals may be detected by the one or more second sensors included in the timestamp detection unit 350. The musical rhythm generation unit 620 may generate one of a plurality of measures based on two timestamps of the plurality of timestamps. The musical rhythm generation unit 620 may further record and group the generated tune into the corresponding measures based on the plurality of timestamps. It should be understood that the musical tune of different measures may form the musical rhythm. For example, during the period of playing the keyboard instrument by a user, the user may randomly classify the playing tune into her/his desired measure at any moment. As another example, after creating the first length of musical piece, the first timestamp may be recorded according to the user's performance at time A (e.g., a nodding gesture). The user may continue creating the second length of the musical piece; the second timestamp may be recorded according to the user's performance at time B. Similarly, more timestamps associated with the playing musical piece may be recorded. The musical rhythm generation unit 620 may generate the musical rhythm based on the creating musical tune between every two adjacent timestamps.

The musical score generation unit 630 may be configured to generate the musical score based on the musical tune and the musical rhythm. In some embodiments, the musical score generation unit 630 may generate a plurality of musical notes based on the musical tune. The musical score generation unit 630 may classify the plurality of notes into the plurality of measures based on the musical rhythm. The musical score generation unit 630 may further determine the musical score based on the classified notes. In some embodiments, the musical score generation unit 630 may generate the musical score based on the classified notes and one or more composing parameters. The composing parameters may include but not limited to a time signature, a key signature, a clef, and/or a number count of measures. In some embodiments, the musical score generation unit 630 may transmit the musical score to a user interface to display. In some embodiments, the musical score may be stored in the form of MIDI file.

It should be noted that the signal processing module 230 described above is provided for the purposes of illustration, and not intended to limit the scope of the present disclosure. Apparently, for persons having ordinary skills in the art, numerous variations and modifications may be conducted under the teaching of the present disclosure. However, those variations and modifications may not depart the scope of the present disclosure. Some units in the signal processing module 230 may be integrated into a single unit. For example, the musical tune generation unit 610 and the musical rhythm generation unit 620 may be integrated into a single unit.

Figure 7:
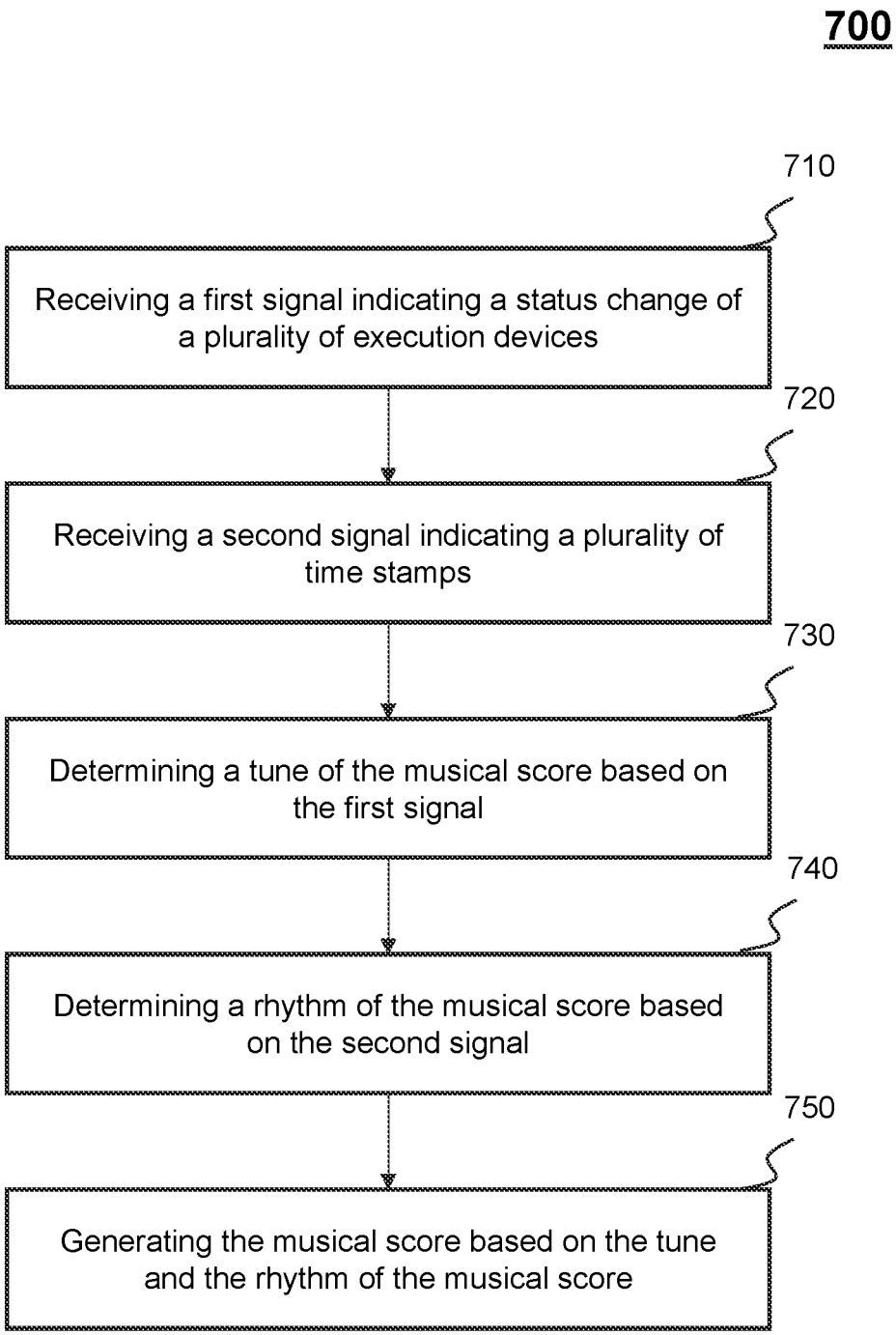
FIG. 7 is a flowchart illustrating an exemplary method of generating a musical score for a keyboard instrument system according to some embodiments of the present disclosure.

FIG. 7 is a flowchart illustrating an exemplary process and/or method of generating a musical score for a keyboard instrument system according to some embodiments of the present disclosure. The process and/or method 700 may be executed by a processor in the keyboard instrument system 100 (e.g., the processor 120). For example, the process and/or method 700 may be implemented as a set of instructions (e.g., an application) stored in a non-transitory computer-readable storage medium (e.g., the memory 130, or the storage 140). The processor may execute the set of instructions and may accordingly be directed to perform the process 700 via receiving and/or sending electronic signals.

In 710, the processor (e.g., the signal acquisition module 220) may receive a first signal indicating a status change of a plurality of execution devices of the keyboard instrument system 100. Exemplary execution devices may include but not limited to a key, a pedal, a hammer, a string, etc. For an exemplary keyboard instrument, such as a piano, the strings of the piano's soundboard are arranged into octaves that may be played by depressing the various keys and/or the pedals of the piano, which causes the corresponding hammer to strike their respective strings, thereby causing them to vibrate at a resonant frequency to produce corresponding characteristic sounds. The characteristic sounds may be represented in the form of notes. In other words, the playing sounds by the keyboard instrument may be up to the status change of at least one of the plurality of execution devices. The status change of the plurality of execution devices may include at least one of a position change of a key, a position change of a pedal, or a vibration status change of a string. The various status change detection units in the signal acquisition module 220 may be configured to detect the status change of the plurality of the keyboard instrument. For example, as illustrated in FIG. 3, the key detection unit 310 in the signal acquisition module 220 may be configured to detect the position change of the key, the pedal detection unit 320 may be configured to detect the position change of the pedal, the hammer detection unit 330 may be configured to detect the position change of the hammer, the string detection unit 340 may be configured to detect the vibration status change of the string. It should be noted that the status change detection units may include one or more sensors to detect the plurality of status changes. The one or more sensors to detect the status change of the execution device herein may also be referred to as the first sensor(s).

In some embodiments, the first sensor(s) may include various types of sensors to detect motions of the execution devices. For example, exemplary first sensor(s) may include an electro-optical sensor, an electromagnetic sensor, a Hall sensor, a vibration sensor, an ultrasonic sensor, a laser sensor, a motion sensor, a piezoelectricity sensor, a pressure sensor, a torque sensor, a resistance sensors, a conductivity sensor, a tilt sensor or the like, or any combination thereof. In some embodiments, the first sensor(s) may transmit the generated first signal(s) related to the status change of the execution devices to the processor (e.g., the signal processing module 230) for further processing.

In 720, the processor (e.g., the signal acquisition module 220) may receive a second signal indicating a plurality of timestamps. The timestamp may refer to a moment when the user's performance occurs. For example, when a user performs the performance (e.g., a nodding, a shaking, or a humming), the second sensor(s), or otherwise detection elements, may generate a second signal that indicates the timestamp recording the performance behavior. The second sensor(s) may further transmit the second signal to the processor (e.g., the signal processing module 230) for further processing. It should be noted that, when a composer creates a music piece by the keyboard instrument, in a musical score, the music piece may be divided into measures in the music score. Each measure, between two sets of bars, may represent a small amount of time that governs the beat or pulse of the music being played. The beat may be used to measure the rhythm of the music. In the case, a timestamp may be designated as an indicator of a beat. Therefore, the playing/composing music between two timestamps may be designated as a beat.

As illustrated in FIG. 3, the second sensor(s) may be configured in the timestamp detection unit 350. The types of the second sensors may depend on the method to detect the timestamp associated with a musical rhythm according to the user' performance. For example, a nodding or shaking his/her head may represent a hinting signal that indicates the musical rhythm (e.g., a beat), a camera (i.e., the second sensor) may be configured to acquire the corresponding image of the nodding or the shaking in order to record the timestamp of occurring the nodding and/or shaking. As another example, a specific sound produced by the user (e.g., a humming) may represent the hinting signal that indicates the musical rhythm, an audio sensor (i.e., the second sensor) may be configured to detect the specific sound in order to record the timestamp when the specific sound is detected. As still another example, a motion sensor, placed on the extend pedal, may be configured to detect the hinting signal based on the position change of the extend pedal. The extend pedal may refer to the pedal different from the typical three pedals of the keyboard instrument, such as the soft pedal, sostenuto, and sustain pedal. A corresponding timestamp may be recorded once the composer steps down the extend pedal. For those skilled in the art, various types of sensors may be used to detect the hinting signal that indicates the musical rhythm. The detected hinting signal may be referred to as the second signal herein.

In 730, the processor (e.g., the musical tune generation unit 610) may determine a tune of the musical score based on the first signal. In some embodiments, the first signal(s) that indicates status change of the execution devices may include keystroke data, pedal pressing data, hammer striking data, and/or string striking data, etc. In some embodiments, the first signal(s) may be converted into a sound by a signal processing circuit 160. That is the musical tune. In some embodiments, the signal processing circuit 160 may include a signal amplification circuit, a signal conversion circuit, a signal filtering circuit, a channel selecting circuit, an analog-to-digital converter, or the like, or any combination thereof. In some embodiments, the determined musical tune may be played by a sound system (e.g., a loudspeaker, a media player). In some embodiments, the determined musical tune may be stored in the form of MIDI file. In some embodiments, the musical tune signals may be transmitted to the processor (e.g., the musical score generation unit 630 in the signal processing module 230) to determine the corresponding musical note signals.

In 740, the processor (e.g., the musical rhythm generation unit 620) may determine a rhythm of the musical score based on the second signal. The second signal may include the timestamps data corresponding to the user's performance. In some embodiments, the processor (e.g., the musical rhythm generation unit 620) may determine a beat duration between two adjacent timestamps. The musical rhythm may be determined based on a plurality of beats. In some embodiments, there may be two or more beats between two adjacent timestamps. For example, a beat may be divided based on the average time duration between the two adjacent timestamps. Alternatively or additionally, a beat may be divided based on the preset proportion of the time duration between two adjacent timestamps. For those skilled in the art, a beat may include one or more playing musical notes. The musical notes may include a whole note, a half note, a quarter note, an eighth note, a sixteen note, a thirty-second note, a sixty-fourth note, or the like, or any combination thereof. In some embodiments, the musical rhythm may be transmitted to the processor (e.g., the musical score generation unit 630) for further processing.

In some embodiments, while the user is composing the music piece by playing the keyboard instrument (e.g., pressing the keys, or depressing the pedal), the beat may be recorded randomly and synchronously according to the user's performance. The beat may be recorded based on the timestamps when the performance occurs.

In 750, the processor (e.g., the musical score generation unit 630) may generate the musical score based on the tune and the rhythm of the musical score. In some embodiments, the musical notes may be determined in response to the playing tune. For example, the corresponding notes may be determined according to the movement of the keys and/or the pedals. Each of the keys in the keyboard instrument system 100 may correspond to a characteristic musical note. In other words, the musical tune may be defined as the plurality of notes of the musical score. In some embodiments, the processor may determine a plurality of measures based on the musical rhythm. One of the plurality of the measures may be determined based on two timestamps of the plurality of timestamps. In some embodiments, bar ends (or bar lines) corresponding to the timestamps may be represented in the musical score. Each measure, between two bar ends, may represent the time that governs the beat being played. In some embodiments, the processor may classify the plurality of notes into the plurality of the measures. For example, the processor may classify the first length of notes, corresponding to the first length of musical tune, into the first measure. The second length of notes, corresponding to the second length of musical tune, into the second measure. The musical score may be determined based on the sets of the classified notes.

In some embodiments, the musical score may also depend on one or more composing parameters. The one or more composing parameters may include a time signature, a key signature, a clef, or a number count of measures, or the like, or any combination thereof. For a typical musical score (e.g., a staff), at the beginning of the music staff, there will be a time signature. Time signature defines the meter of the music to be played. The key signature is typically notated after the clef and shows the key for the musical piece to be played. The key signature may include a set of sharp, flat, and/or natural. The clef may define the pitch range of the musical piece. The clef functions as a designator to assign individual notes to the given lines and/or spaces of the staff. In some embodiments, the processor (e.g., the musical score generation unit 630) may also take into consideration these composing parameters for generating an entire musical score. In the case, the musical score may be determined based on the classified notes and the one or more composing parameters. The user may input the one or more composing parameters associated with the musical score via a user interface.

In some embodiments, the processor (e.g., the musical score generation unit 630) may transmit the determined musical score to the user interface. The musical score may be displayed on the user interface. In some embodiments, the user may modify the musical score via the user interface. When the processor (e.g., the modification unit 244 in the computing module 240) receives one or more instructions for modifying the musical score, the processor may further modify the musical score based on the one or more instructions. For example, if the user wants to move the position of a note, the user may directly move the note to the desired position on the user interface.

Figure 8:
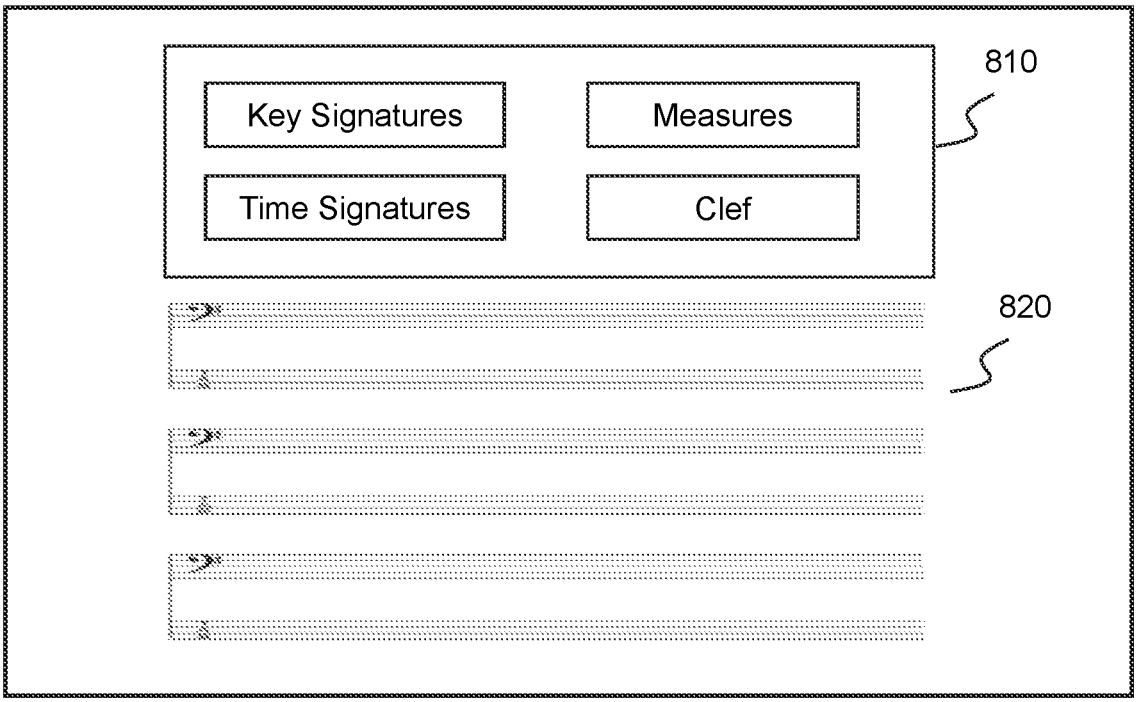
FIG. 8 is a schematic diagram illustrating an exemplary user interface according to some embodiments of the present disclosure.

FIG. 8 is a schematic diagram illustrating an exemplary user interface 800 according to some embodiments of the present disclosure. As shown in FIG. 8, area 810 may refer to a composing parameter setting unit. The corresponding composing parameter may be set based on the input of the user. For example, the user may touch the area of the composing parameters to modify the parameter. As another example, the user may also modify the composing parameter via an audio. Merely for illustration in FIG. 8, the composing parameters displayed on the user interface 800 are not exhaustive and are not limiting. Various composing parameters may be displayed on the user interface 800. Area 820 may display the determined musical score on the user interface 800. The musical score may exist in various forms, such as a staff, a numbered musical notation. The user may modify the musical score directly via the user interface. In some embodiments, the musical notes within the different measures may be displayed in different colors and/or the same color.

It should be borne in mind, however, that all of these and similar terms are to be associated with the appropriate physical quantities and are merely convenient labels applied to these quantities. Unless specifically stated otherwise, as apparent from the following discussion, it is appreciated that throughout the description, discussions utilizing terms such as "sending," "receiving," "generating," "providing," "calculating," "executing," "storing," "producing," "determining," "obtaining," "calibrating," "recording," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The terms "first," "second," "third," "fourth," used herein are meant as labels to distinguish among different elements and may not necessarily have an ordinal meaning according to their numerical designation.

In some implementations, any suitable computer-readable media can be used for storing instructions for performing the processes described herein. For example, in some implementations, computer-readable media can be transitory or non-transitory. For example, non-transitory computer-readable media can include media such as magnetic media (such as hard disks, floppy disks), optical media (such as compact discs, digital video discs, Blu-ray discs), semiconductor media (such as flash memory, electrically programmable read-only memory (EPROM), electrically erasable programmable read-only memory (EEPROM)), any suitable media that is not fleeting or devoid of any semblance of permanence during transmission, and/or any suitable tangible media. As another example, transitory computer readable media can include signals on networks, in connectors, conductors, optical fibers, circuits, and any suitable media that is fleeting and devoid of any semblance of permanence during transmission, and/or any suitable intangible media.

It should be noted that the piano equipped with the heat dissipation system in some specific embodiments is provided for the purposes of illustration, and not intended to limit the scope of the present disclosure. Apparently, for persons having ordinary skills in the art, numerous variations and modifications may be conducted under the teaching of the present disclosure. However, those variations and modifications may not depart the protecting scope of the present disclosure.

Furthermore, the recited order of processing elements or sequences, or the use of numbers, letters, or other designations, therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose and that the present disclosure is not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software-only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various inventive embodiments. This method of disclosure, however, is not to be interpreted as reflecting an intention that the claimed subject matter requires more features than are expressly recited in each claim. Rather, inventive embodiments lie in less than all features of a single foregoing disclosed embodiment.

What is claimed is:

1. A method for generating a musical score based on user performance during playing a keyboard instrument, the method comprising:

detecting, by a first sensor, a status change of a plurality of execution devices of the keyboard instrument;

generating, by the first sensor, a first signal according to the detected status change;

detecting, by a second sensor, at least one of a user's performance, a specific sound, or a position change of an extend pedal;

generating, by the second sensor, a second signal indicating a plurality of timestamps;

determining, by a processor, a tune of the musical score based on the first signal, wherein the tune includes one or more pitches;

determining, by the processor, a rhythm of the musical score based on the second signal; and generating, by the processor, the musical score based on the tune and the rhythm of the musical score.

2. The method of claim 1, further comprising:

displaying the musical score on a user interface.

3. The method of claim 2, further comprising:

receiving, via the user interface, an input related to one or more composing parameters associated with the musical score.

4. The method of claim 3, wherein the one or more composing parameters associated with the musical score include one of a time signature, a key signature, a clef, or a number count of measures.

5. The method of claim 3, wherein generating, by the processor, the musical score based on the tune and the rhythm of the musical score comprises:

generating, based on the tune, a plurality of notes;

generating, based on the rhythm, a plurality of measures;

classifying the plurality of notes into the plurality of measures; and generating the musical score based on the classified notes and the input related to one or more composing parameters associated with the musical score.

6. The method of claim 5, wherein one of the plurality of the measures is determined based on two of the plurality of timestamps.

7. The method of claim 1, wherein the plurality of execution devices include at least one of a key, a pedal, a hammer, a weight lever, or a string.

8. The method of claim 7, wherein the status change of the plurality of execution devices includes at least one of:

a position change of a key;

a position change of a pedal;

a position change of a hammer; or a vibration status change of a string.

9. The method of claim 1, further comprising:

receiving, via a user interface, one or more instructions for modifying the musical score; and modifying, by the processor, the musical score based on the one or more instructions.

10. A system for generating a musical score based on user performance during playing a keyboard instrument, comprising:

at least one storage device storing a set of instructions;

a first sensor configured to:

detect a status change of a plurality of execution devices of the keyboard instrument; and generate a first signal according to the detected status change;

a second sensor configured to:

detect at least one of a user's performance, a specific sound, or a position change of an extend pedal; and generate a second signal indicating a plurality of timestamps; and at least one processor in communication with the at least one storage device, wherein when executing the instructions, the at least one processor is configured to cause the system to:

obtain the first signal;

obtain the second signal;

determine a tune of the musical score based on the first signal;

determine a rhythm of the musical score based on the second signal; and generate the musical score based on the tune and the rhythm of the musical score.

11. The system of claim 10, further comprising:

a user interface configured to display the musical score.

12. The system of claim 11, wherein the user interface is further configured to receive an input related to one or more composing parameters associated with the musical score.

13. The system of claim 12, wherein the one or more composing parameters associated with the musical score include one of a time signature, a key signature, a clef, or a number count of measures.

14. The system of claim 12, wherein to generate the musical score based on the tune and the rhythm of the musical score, the at least one processor is further configured to cause the system to:

generate, based on the tune, a plurality of notes;

generate, based on the rhythm, a plurality of measures;

classify the plurality of notes into the plurality of measures; and generate the musical score based on the classified notes and the input related to one or more composing parameters associated with the musical score.

15. The system of claim 14, wherein one of the plurality of measures is determined based on two of the plurality of timestamps.

16. The system of claim 10, wherein the plurality of execution devices include at least one of a key, a pedal, a hammer, a weight lever, or a string.

17. The system of claim 16, wherein the status change of the plurality of execution devices includes at least one of:

a position change of a key;

a position change of a pedal;

a position change of a hammer; or a vibration status change of a string.

18. The system of claim 10, wherein the at least one processor is further configured to cause the system to:

receive one or more instructions for modifying the musical score; and modify the musical score based on the one or more instructions.

19. A non-transitory computer readable medium embodying a computer program product, the computer program product comprising instructions configured to cause a computing device to:

detect, by a first sensor, a status change of a plurality of execution devices of a keyboard instrument;

generate, by the first sensor, a first signal according to the detected status change;

detect, by a second sensor, at least one of a user's performance, a specific sound or a position change of an extend pedal;

generate, by the second sensor, a second signal indicating a plurality of timestamps;

determine, by a processor, a tune of a musical score based on the first signal wherein the tune includes one or more pitches;

determine, by the processor, a rhythm of the musical score based on the second signal; and generate, by the processor, the musical score based on the tune and the rhythm of the musical score.

20. The non-transitory computer readable medium of claim 19, wherein the instructions are further configured to cause a computing device to:

display the musical score on a user interface.

* * * * *